US010712696B2

(12) United States Patent
Takazawa

(10) Patent No.: US 10,712,696 B2
(45) Date of Patent: Jul. 14, 2020

(54) FIXING DEVICE HAVING A HEAT SUPPLY PART AND IMAGE FORMING APPARATUS

(71) Applicant: Oki Data Corporation, Minato-ku, Tokyo (JP)

(72) Inventor: Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/416,633

(22) Filed: May 20, 2019

(65) Prior Publication Data

US 2020/0004184 A1 Jan. 2, 2020

(30) Foreign Application Priority Data

Jun. 27, 2018 (JP) ..... 2018-122183

(51) Int. Cl.
*G03G 15/20* (2006.01)

(52) U.S. Cl.
CPC . *G03G 15/2057* (2013.01); *G03G 2215/2025* (2013.01)

(58) Field of Classification Search
CPC ..... G03G 15/2017; G03G 15/2042; G03G 15/2053
USPC ..... 399/329, 334
See application file for complete search history.

(56) References Cited

U.S. PATENT DOCUMENTS 9,122,214 B2 * 9/2015 Matsumoto et al. ..... G03G 15/2053
10,459,383 B2 * 10/2019 Sato ..... G03G 15/2053

FOREIGN PATENT DOCUMENTS

JP 2016-065915 A 4/2016

* cited by examiner

*Primary Examiner* — William J Royer
(74) *Attorney, Agent, or Firm* — Panitch Schwarze Belisario & Nadel LLP

(57) ABSTRACT

A fixing device includes an endless belt. A heat supply part is disposed inside the belt, contacts an inner circumferential surface thereof, and supplies heat thereto. A pressure member contacts an outer circumferential surface of the belt to form a nip portion, and conveys a recording medium while nipping the recording medium together with the belt. The heat supply part includes a heater having a plurality of heating sections arranged in a widthwise direction of the belt, and a thermal diffusion member extending in the widthwise direction between the heater and the belt. One surface of the thermal diffusion member contacts the inner circumferential surface of the belt, and the other surface contacts the heating sections. A plate thickness t (mm) between the surfaces of the thermal diffusion member, and a thermal diffusivity D ($mm^2/s$) of the thermal diffusion member satisfy the relationship: $t \times D \geq 6.7$.

10 Claims, 12 Drawing Sheets

FIXING DEVICE HAVING A HEAT SUPPLY PART AND IMAGE FORMING APPARATUS

CROSS-REFERENCE TO RELATED APPLICATION

This application claims priority under 35 U.S.C. § 119(b) to Japanese Application No. 2018-122183, filed Jun. 27, 2018, the disclosure of which is incorporated by reference herein in its entirety.

BACKGROUND OF THE INVENTION

1. Field of the Invention

The present invention relates to an electrophotographic image forming apparatus and more particularly relates to a thermal fixing device including a fixing belt.

2. Description of the Related Art

A general fixing device includes a fixing belt and a heater for heating the fixing belt. The heater has a plurality of divided heating sections arranged in a widthwise direction of the fixing belt. One or more of the heating sections corresponding to a printing image area that varies depending on a size of a printing medium is caused to generate heat (see, for example, Patent Reference 1).

Patent Reference 1: Japanese Patent Application Publication No. 2016-65915 (page 7, FIG. 5)

SUMMARY OF THE INVENTION

However, in the heater, a temperature gap occurs between the heating section and a border section between the adjacent heating sections. This causes a variation in temperature of a surface of the belt (i.e., a surface contacting a developer), and thus gloss unevenness occurs in a fixed image.

An embodiment of the present invention is intended to reduce a temperature gap on a surface of an endless belt, and to reduce gloss unevenness of a printing image.

According to an embodiment of the present invention, there is provided a fixing device including an endless belt, and a heat supply part disposed inside the endless belt. The heat supply part contacts an inner circumferential surface of the endless belt, and supplies heat to the endless belt. The fixing device further includes a pressure member that contacts an outer circumferential surface of the endless belt to form a nip portion, and conveys a recording medium while nipping the recording medium together with the endless belt. The heat supply part includes a heater having a plurality of heating sections arranged in a widthwise direction of the endless belt, and a thermal diffusion member that extends in the widthwise direction between the heater and the endless belt. The thermal diffusion member is disposed so that one surface thereof contacts the inner circumferential surface of the endless belt, and the other surface thereof contacts the plurality of heating sections.

A plate thickness t (mm) between the one surface and the other surface of the thermal diffusion member, and a thermal diffusivity D ($mm^2/s$) of the thermal diffusion member satisfy the relationship: $t \times D \geq 6.7$.

With such a configuration, even when the heater of the fixing device has divided heating sections, a temperature gap on a surface of the endless belt can be reduced, and therefore gloss unevenness of a printing image can be reduced.

DETAILED DESCRIPTION OF THE PREFERRED EMBODIMENT

Embodiment 1

Figure 1:
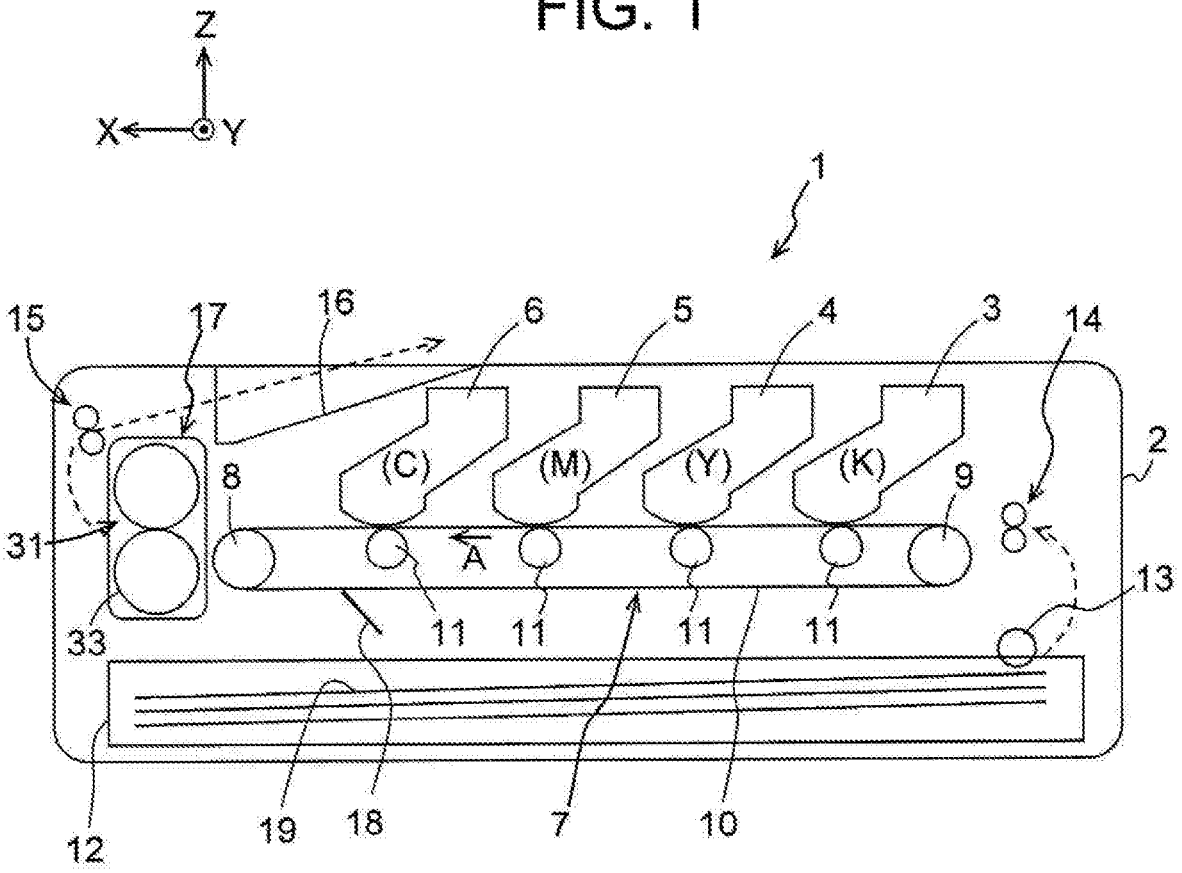
FIG. 1 is a diagram illustrating a configuration of a main part of an image forming apparatus including a fixing device of Embodiment 1 of the present invention.
Figure 2:
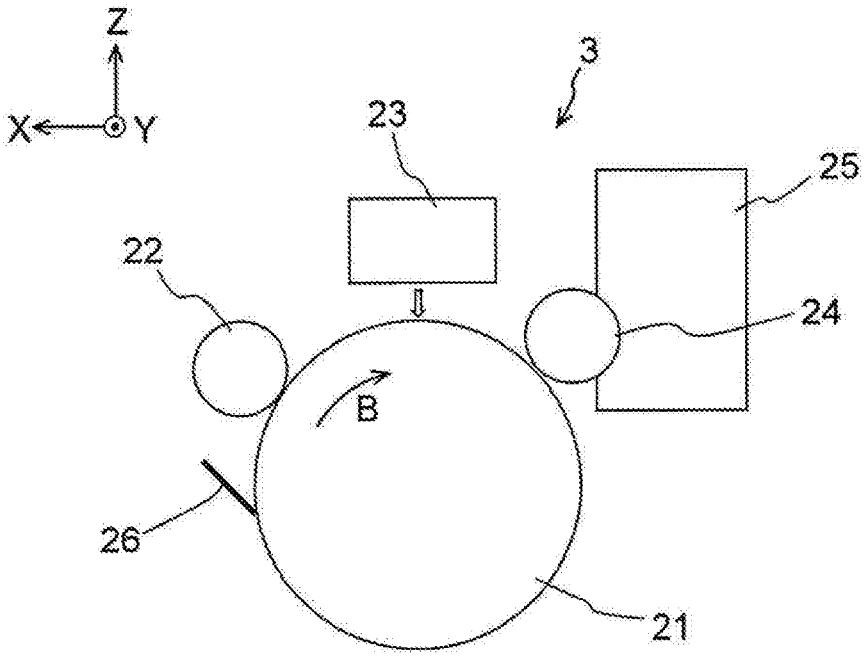
FIG. 2 is a diagram illustrating a configuration of a main part of an image forming unit.

FIG. 1 is a diagram illustrating a configuration of a main part of an image forming apparatus 1 including a fixing device 17 according to Embodiment 1 of the present invention. FIG. 2 is a diagram illustrating a configuration of a main part of an image forming unit 3.

As shown in FIG. 1, the image forming apparatus 1 includes a sheet feed cassette 12, a hopping roller 13, a pair of registration rollers 14, and a housing 2 accommodating these components. The sheet feed cassette 12 stores recording sheets 19 as recording media. The hopping roller 13 takes the recording sheet 19 out of the sheet feed cassette 12. The pair of registration rollers 14 correct a skew of the recording sheet 19 and convey the recording sheet 19 to an image forming section. In the housing 2, image forming units 3, 4, 5 and 6 are arranged in this order from an upstream side along a conveyance path of the recording sheet 19 conveyed in a direction indicated by an arrow A. The image forming units 3 through 6 are configured to form toner images (developer images) of black (K), yellow (Y), magenta (M), and cyan (C). The image forming units 3 through 6 constitute the image forming section.

The image forming units 3 through 6 have the same configurations except for toners. Therefore, a configuration of the image forming unit 3 of black (K) will be described with reference to FIG. 2 as a representative example.

The image forming unit 3 includes, for example, a photosensitive drum 21 as an image bearing body, a charging roller 22 as a charging device, a developing roller 24 as a developer bearing body, a toner cartridge 25 as a developer storage container storing a toner (developer), and a cleaning blade 26.

As illustrating in FIG. 2, LED heads 23 as exposure devices are disposed respectively above the image forming units 3 through 6 so that the LED heads 23 face the photosensitive drums 21. A transfer unit 7 (FIG. 1) is disposed below the image forming units 3 through 6.

The transfer unit 7 includes a driving roller 8, a driven roller 9, a transfer belt 10, transfer rollers 11 as transfer members, and a cleaning blade 18 as a cleaning member. The driven roller 9 is disposed at a position apart from the driving roller 8 by a predetermined distance. The transfer belt 10 is wound around the driving roller 8 and the driven roller 9, and is driven to move in a direction indicated by an arrow A. The transfer rollers 11 are disposed so as to face the photosensitive drums 21 of the image forming units 3 through 6 via the transfer belt 10. The cleaning blade 18 is disposed so that its edge (tip) abuts against the transfer belt 10.

In FIG. 1, an X-axis is defined in a conveying direction of the recording sheet 19 when the recording sheet 19 passes through the image forming units 3 through 6. A Y-axis is defined in a direction of a rotation axis of each photosensitive drum 21. A Z-axis is defined in a direction perpendicular to the X-axis and the Y-axis. When the X-axis, Y-axis, and Z-axis are represented in other drawings (to be described later), the directions of the X-axis, Y-axis and Z-axis indicate the same directions as those in FIG. 1. In other words, the X-axis, Y-axis, and Z-axis in each drawing indicate the directions when a part illustrated in the drawing is assembled into the image forming apparatus 1 illustrated in FIG. 1. Here, the Z-axis is substantially a vertical direction.

The cleaning blade 18 is provided for scraping off toner (adhering to the transfer belt 10 from the photosensitive drums 21 shown in FIG. 2) from the transfer belt 10. The fixing device 17 is disposed downstream of the transfer unit 7 in the sheet conveying direction. The fixing device 17 includes a fixing belt unit 31 and a pressure roller 33 as a pressure member, as will be described later. A pair of conveying rollers 15 convey the recording sheet 19 to which a toner image is fixed by the fixing device 17 to a pair of ejection rollers (not illustrated), and eject the recording sheet 19 onto a stacker 16 provided outside the housing 2. The fixing device 17 will be described in detail later.

Next, a printing operation of the image forming apparatus 1 having the above described configuration will be described.

When the hopping roller 13 located at a front end of the sheet feed cassette 12 rotates, the recording sheet 19 is fed out of the sheet feed cassette 12, and is fed to the registration rollers 14 in a direction indicated by a dotted arrow. The registration rollers 14 temporarily stop the recording sheet 19 to correct a skew of the recording sheet 19, and rotate to feed the recording sheet 19 into between the photosensitive drum 21 (FIG. 2) of the image forming unit 3 rotating in a direction indicated by an arrow B and the transfer belt 10 moving in the direction indicated by the arrow A.

In each of the image forming units 3, 4, 5, and 6, a surface of the photosensitive drum 21 (FIG. 2) is uniformly charged by the charging roller 22, and then selectively exposed to light emitted by light emitting elements of the LED head 23, so that an electrostatic latent image as a latent image is formed on the photosensitive drum 21. In FIG. 2, the toner stored in the toner cartridge 25 is supplied to the developing roller 24 by a toner supply roller (not illustrated), and is formed into a thin layer on a surface of the developing roller 24 by a developing blade (not illustrated). The toner held on the developing roller 24 adheres to the electrostatic latent image on the photosensitive drum 21, so that a toner image (developer image) is formed on the photosensitive drum 21.

The recording sheet 19 fed from the registration rollers 14 is conveyed through between the transfer roller 11 and the photosensitive drum 21 of each of the image forming units 3 through 6 by movement of the transfer belt 10. A voltage whose polarity is opposite to that of the toner image is applied to each transfer roller 11. The toner images of the respective colors on the photosensitive drums 21 of the image forming units 3 through 6 are transferred to the recording sheet 19 in an overlapping manner by electrostatic force, and a color toner image is formed on the recording sheet 19.

The recording sheet 19 is fed to the fixing device 17. In the fixing device 17, the color toner image is heated by the fixing belt unit 31 and pressurized by the pressure roller 33, and is fixed to the recording sheet 19. The recording sheet 19 is further conveyed by the conveying rollers 15 and ejected by the ejection rollers (not illustrated). The ejected recording sheet 19 is placed on the stacker 16 provided outside the housing 2.

After the toner image on the photosensitive drum 21 is transferred to the recording sheet 19, the toner may remain on the surface of the photosensitive drum 21. Such residual toner remaining on the surface of the photosensitive drum 21 is scraped off and removed by the cleaning blade 26 (FIG. 2) by rotation of the photosensitive drum 21.

Figure 3:
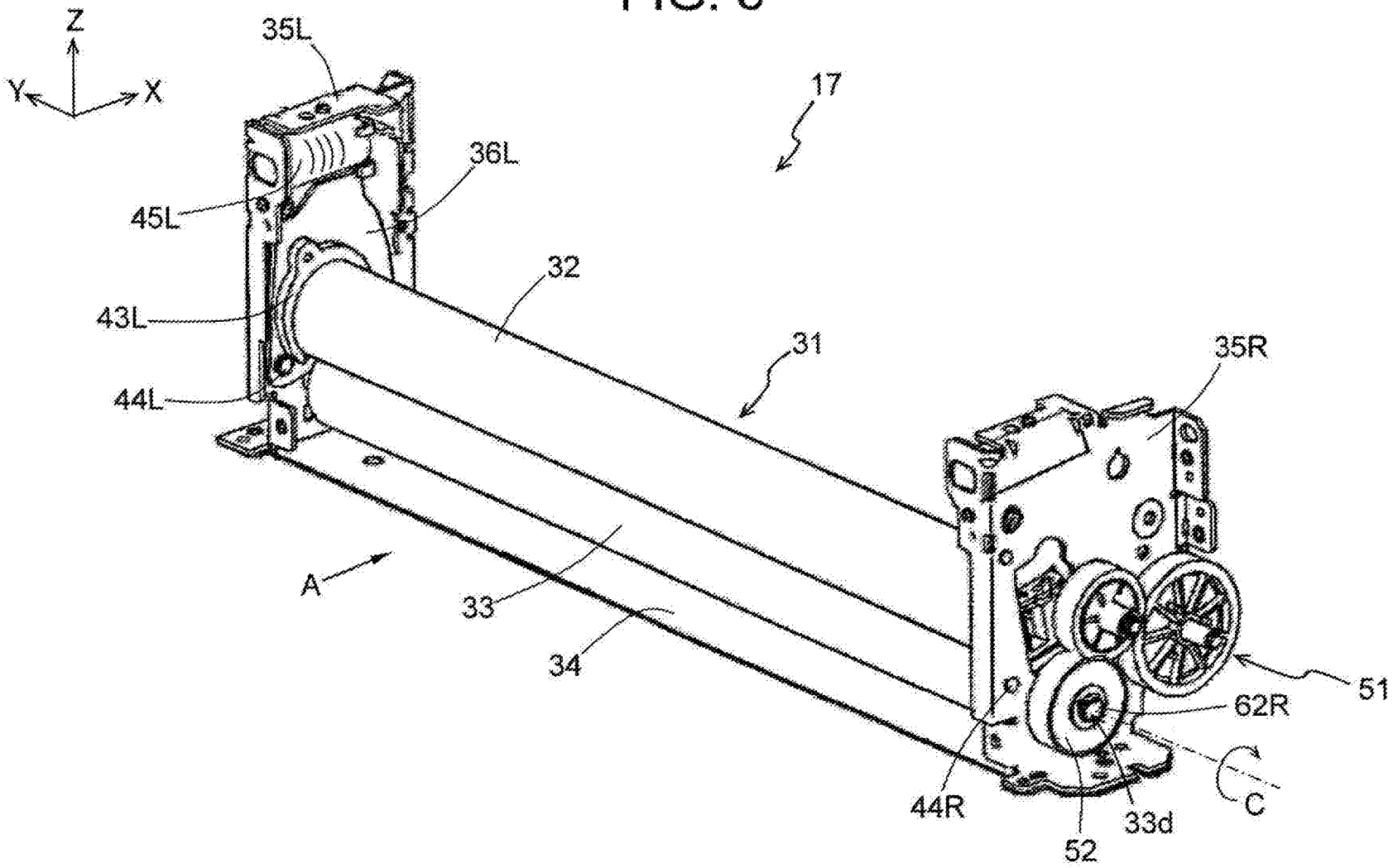
FIG. 3 is a perspective view illustrating an internal structure of a fixing device according to Embodiment 1.
Figure 4A:
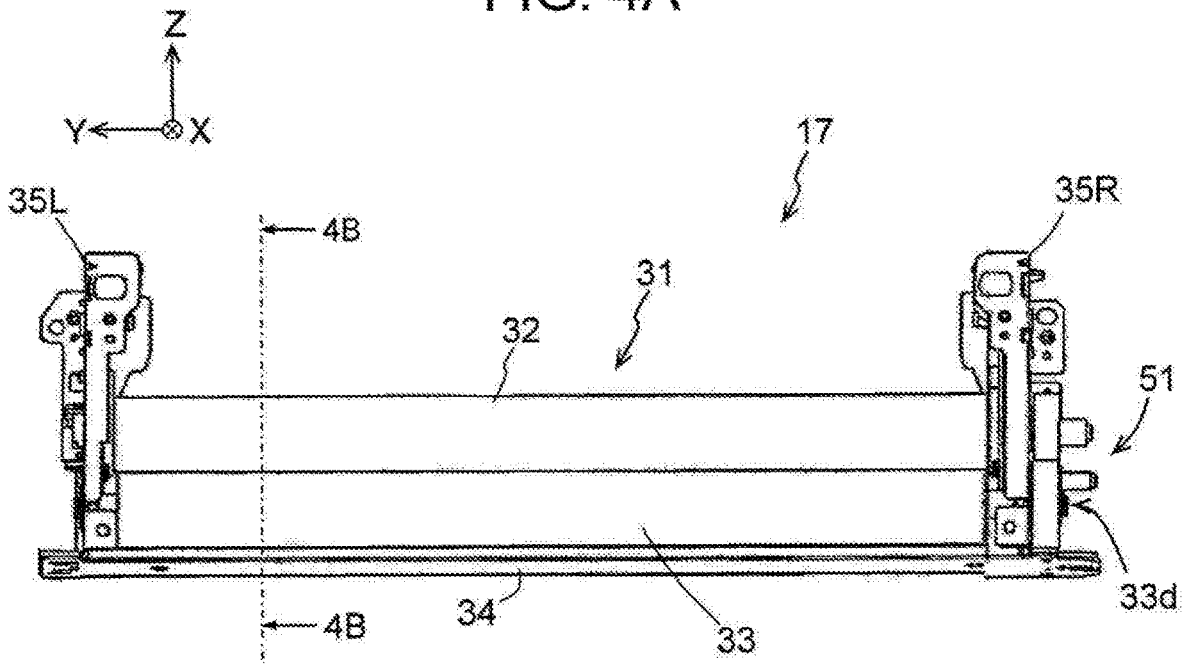
FIG. 4A is a front view illustrating the fixing device as viewed from an upstream side in a sheet conveying direction.
Figure 4B:
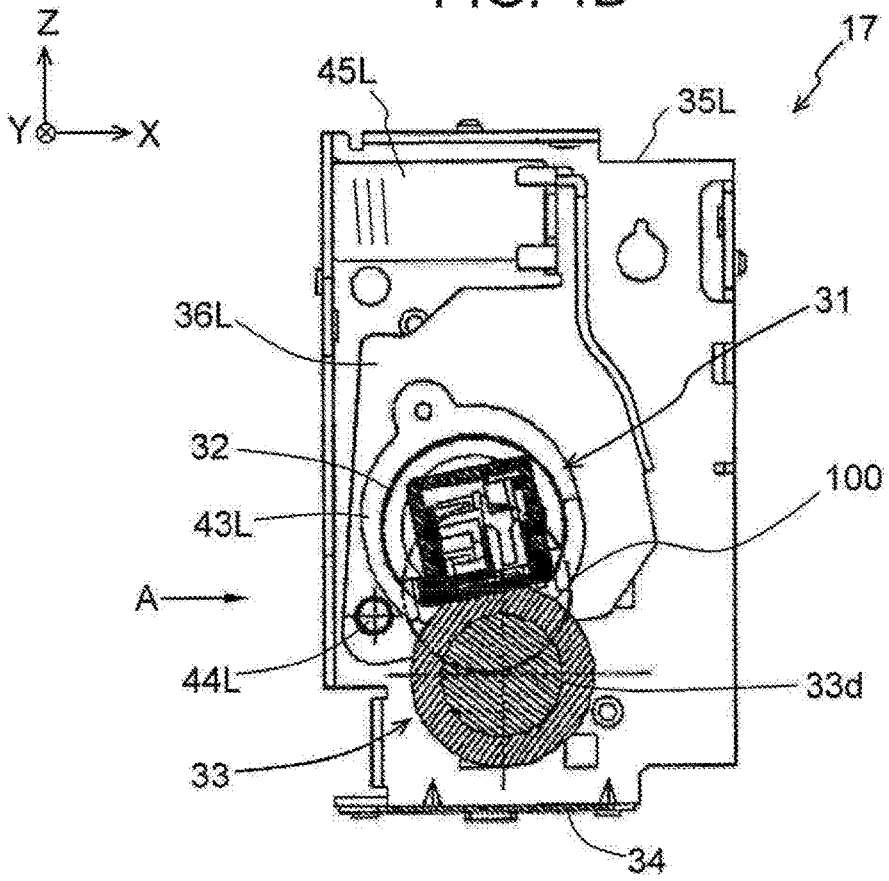
FIG. 4B is a sectional view taken along a line 4B-4B in FIG. 4A.
Figure 5:
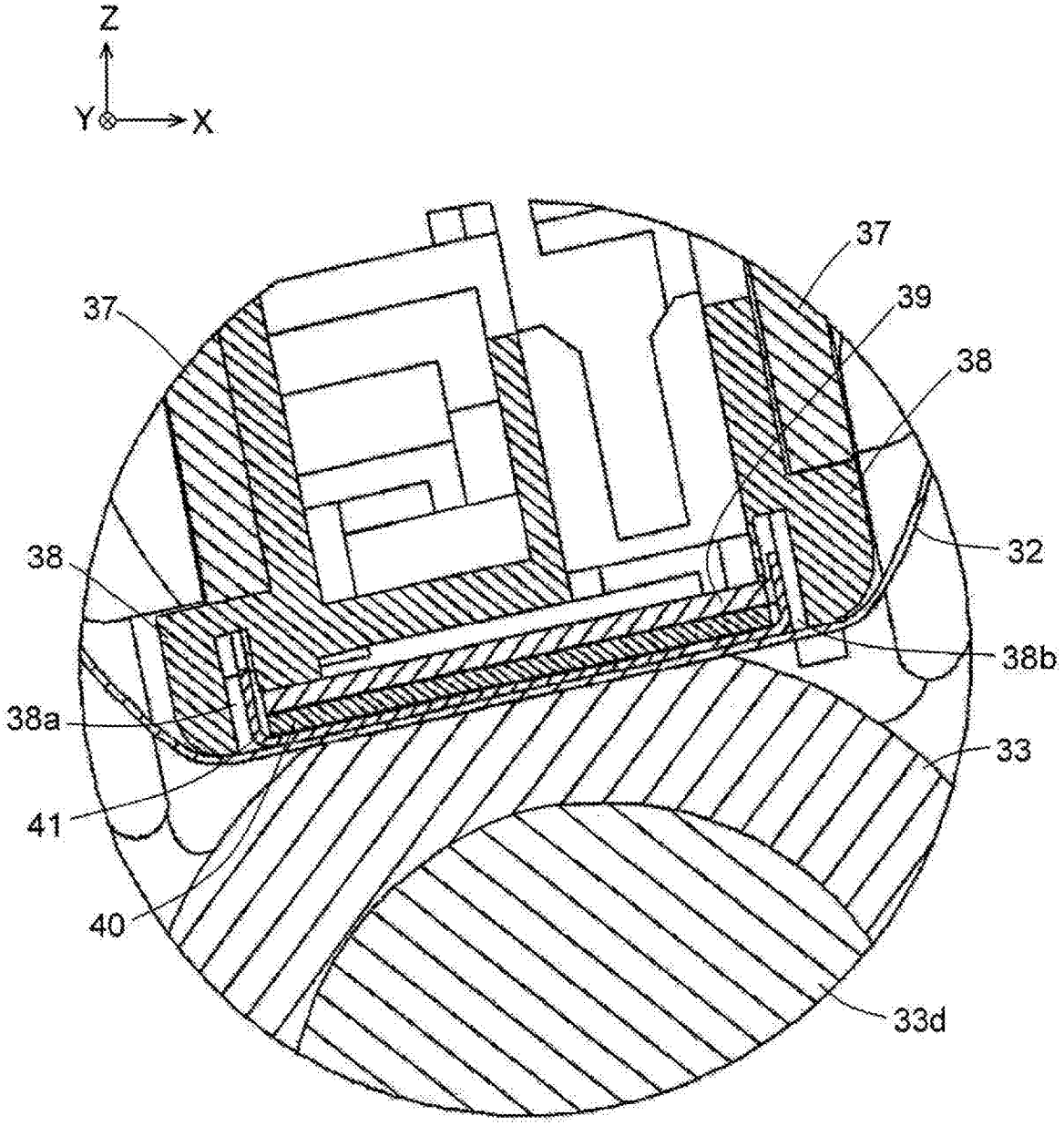
FIG. 5 is a partial enlarged view showing a portion encircled by a dotted circle in FIG. 4B.
Figure 6:
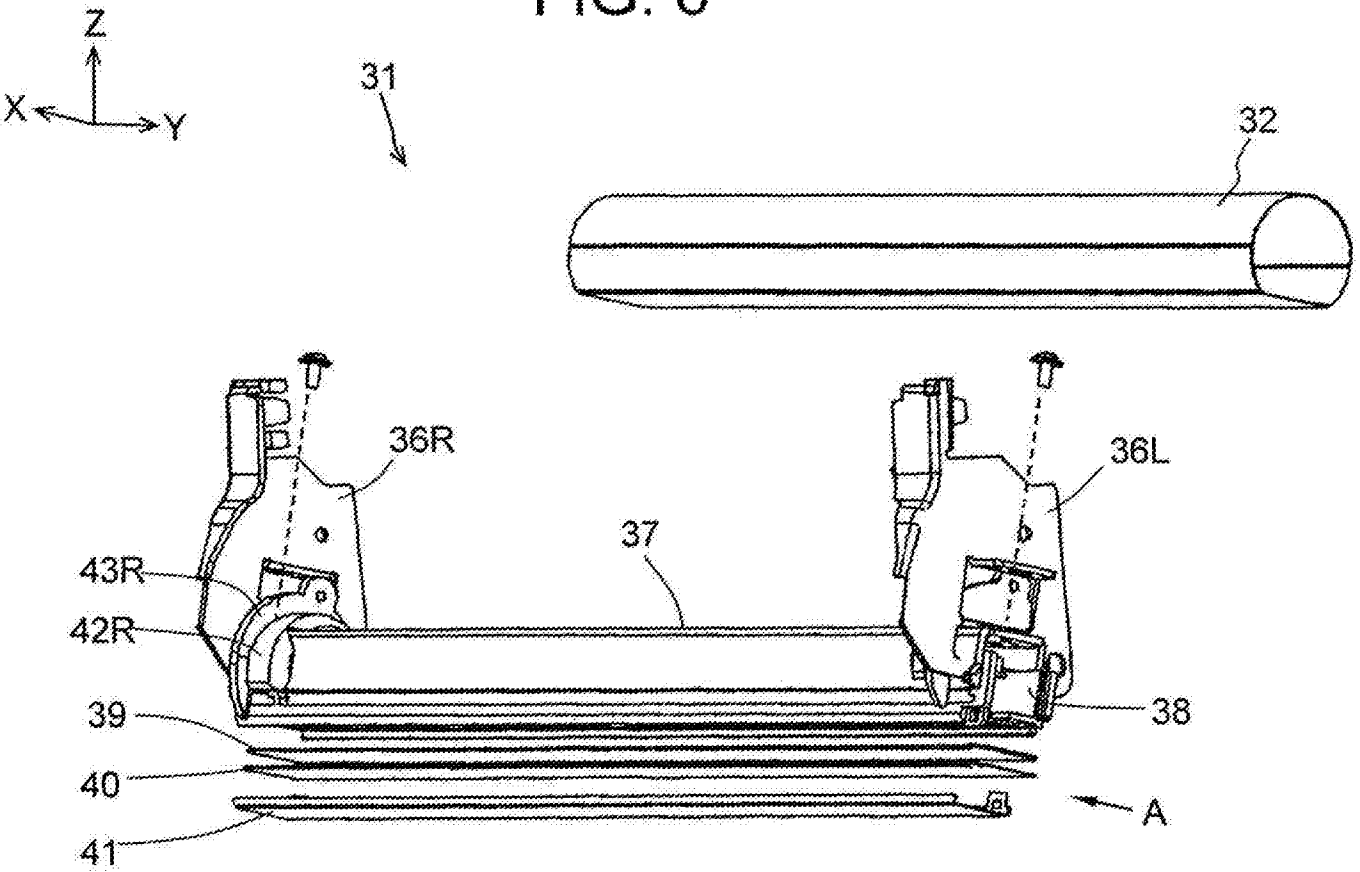
FIG. 6 is an exploded perspective view illustrating a fixing belt unit of the fixing device illustrated in FIG. 3, as viewed in a direction different from that in FIG. 3.

Next, a configuration of the fixing device 17 will be described. FIG. 3 is a perspective view illustrating an internal configuration of the fixing device 17 in Embodiment 1. FIG. 4A is a front view illustrating the fixing device 17 as viewed from an upstream side in the sheet conveying direction (as indicated by the arrow A in FIG. 3). FIG. 4B is a sectional view taken along a line 4B-4B in FIG. 4A. FIG. 5 is a partial enlarged view showing a portion 100 encircled by a dotted circle in FIG. 4B. FIG. 6 is an exploded perspective view illustrating the fixing belt unit 31 of the fixing device 17 illustrated in FIG. 3, as viewed in a direction different from FIG. 3. Left and right, top and bottom, and front and rear of the fixing device 17 may be defined with respect to the sheet conveying direction (direction indicated by the arrow A).

As illustrated in FIG. 3, the fixing device 17 includes a lower frame 34, a left side frame 35L, and a right side frame 35R. The lower frame 34 extends in a longitudinal direction (Y-axis direction; also referred to as a widthwise direction) of the fixing device 17. The left side frame 35L and the right side frame 35R are disposed at both ends of the lower frame 34 in the widthwise direction, and are arranged at right angles with respect to the lower frame 34. The left side frame 35L and the right side frame 35R face each other. These frames 34, 35L and 35R are formed integrally.

The pressure roller 33 includes a metal shaft 33*d* as a rotation shaft. The pressure roller 33 extends in the longitudinal direction of the fixing device 17, and both ends of the metal shaft 33*d* are rotatably held by the left side frame 35L and the right side frame 35R. A right smaller-diameter part 62R (see FIG. 9A) is formed at a right end of the metal shaft 33*d*. The right smaller-diameter part 62R reaches outside the right side frame 35R, and a receiving gear 52 is fixed to the right smaller-diameter part 62R. A drive gear train 51 meshing with the receiving gear 52 is provided on an outer side of the right side frame 35R. The drive gear train 51 transmits a rotational force from a driving source (not illustrated) to the receiving gear 52 so as to rotate the pressure roller 33 in a direction indicated by an arrow C.

As illustrated in FIG. 6, the fixing belt unit 31 includes a stay 37, a left lever 36L, a right lever 36R, a left regulation plate 43L (FIG. 3), a right regulation plate 43R, and a fixing belt 32. The stay 37 extends in the longitudinal direction (Y-axis direction) of the fixing belt unit 31. The left lever 36L and the right lever 36R are fixed to left and right ends of the stay 37 by screws, and face each other. The left regulation plate 43L is disposed between the stay 37 and the left lever 36L. The right regulation plate 43R is disposed between the stay 37 and the right lever 36R. The fixing belt 32 is an endless belt having an endless shape. A holding member 38 is fitted into a lower part of the stay 37, and extends in parallel with the stay 37. The holding member 38 holds a heat retaining plate 39, a heater 40, and a thermal diffusion member 41 in a stacked manner. The heat retaining plate 39, the heater 40 and the thermal diffusion member 41 extend in parallel with the stay 37.

In this regard, the holding member 38, the heat retaining plate 39, the heater 40, and the thermal diffusion member 41 correspond to a heat supply part. The direction in which the heat retaining plate 39, the heater 40, and the thermal diffusion member 41 extend will be referred to as the longitudinal direction. On a flat surface of a plate part of each of these members, a direction perpendicular to the longitudinal direction will be referred to as a widthwise direction.

As illustrated in FIGS. 5 and 6, the thermal diffusion member 41 is made of a metal plate bent in a rectangular U shape such that two ends of the thermal diffusion member 41 in the widthwise direction face each other. The holding member 38 has a front regulation groove 38*a* and a rear regulation groove 38*b* both extending in the longitudinal direction. The two bent ends of the thermal diffusion member 41 are respectively inserted into the front regulation groove 38*a* and the rear regulation groove 38*b*.

The thermal diffusion member 41 is provided so that the thermal diffusion member 41 and the holding member 38 sandwich the heat retaining plate 39 and the heater 40 therebetween. The two bent ends of the thermal diffusion member 41 are inserted into the front regulation groove 38*a* and the rear regulation groove 38*b*, and the thermal diffusion member 41 contacts an inner surface of the fixing belt 32 (see FIG. 5), as will be described later. In this state, the heat retaining plate 39 and the heater 40 are sandwiched between the holding member 38 and the thermal diffusion member 41 and are movable in the vertical direction.

Thermally conductive grease is applied between the heater 40 and the heat retaining plate 39 and between the heater 40 and the thermal diffusion member 41 so as to efficiently transmit heat from the heater 40 to the heat retaining plate 39 and the thermal diffusion member 41. Plays to allow vertical movement are provided between the front and rear regulation grooves 38*a* and 38*b* of the holding member 38 and the two bent ends of the thermal diffusion member 41 inserted into the grooves 38*a* and 38*b*. The thermal diffusion member 41 is made of a metal plate such as stainless steel, aluminum alloy, or iron. A surface of the thermal diffusion member 41 contacting the fixing belt 32 is applied with a low-friction, highly wear-resistant coating such as glass coating or hard chromium plating, as will be described later.

The fixing belt 32 is mounted so as to surround the holding member 38 into which the stay 37 and the thermal diffusion member 41 are fitted, before the left and right levers 36L and 36R are fixed to the stay 37 with screws. Inner sides of both ends of the fixing belt 32 contact a left arcuate guide (not illustrated) and a right arcuate guide 42R (FIG. 6) formed at both ends of the stay 37, and are slidably held and guided. In a state where the left and right levers 36L and 36R are fixed to the stay 37 with screws via the left and right regulation plates 43L and 43R, lateral movement of the fixing belt 32 is regulated by the left and right regulation plates 43L and 43R.

Optionally, it is also possible that the fixing belt unit 31 has no retaining plate 39. Further, it is also possible that no thermally conductive grease is applied between the heat retaining plate 39 and the heater 40. In this example, sliding grease is further applied to a sliding part between the thermal diffusion member 41 and the fixing belt 32 so as to ensure slidability and prevent wear.

The fixing belt unit 31 having the above-described configuration is rotatably held by the left and right side frames 35L and 35R provided facing each other. The left lever 36L of the fixing belt unit 31 is held by the left side frame 35L so as to be rotatable about a rotation fulcrum 44L, and the right lever 36R of the fixing belt unit 31 is held by the right side frame 35R so as to be rotatable about a rotation fulcrum 44R.

Thus, the entire fixing belt unit 31 is rotatable about a rotation axis extending in the longitudinal direction and including the rotation fulcrums 44L and 44R. A left spring 45L is provided between the left side frame 35L and the left lever 36L in a compressed state. A right spring (not shown) is provided between the right side frame 35R and the right lever 36R in a compressed state. The left spring 45L and the right spring presses the fixing belt 32 against the pressure roller 33 so that a nip portion is formed therebetween as illustrated in FIG. 5.

In the fixing device 17 having the above-described configuration, when the pressure roller 33 rotates in the direction indicated by the arrow C by a rotational force from the driving source (not illustrated), the fixing belt 32 pressed against the pressure roller 33 to form a nip portion therebetween rotates together with the pressure roller 33. The fixing belt 32 heats and presses the recording sheet 19 (at the nip portion) conveyed in the direction indicated by the arrow A, and conveys the recording sheet 19 in the same direction.

Next, a configuration of the fixing belt unit 31 for heating the recording sheet 19 will further be described.

Figure 7:
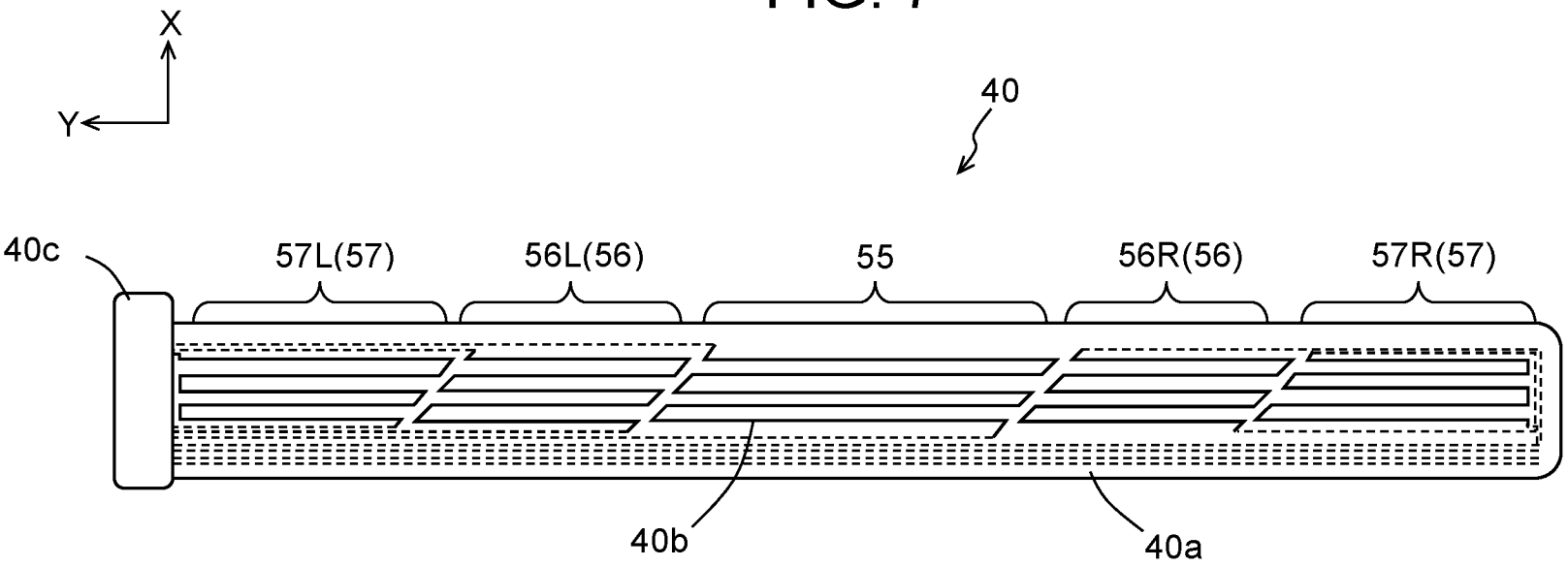
FIG. 7 is a plan view illustrating an internal structure of a heater shown in FIG. 6.

FIG. 7 is a plan view illustrating an internal structure of the heater 40 (see FIG. 6). As illustrated in FIG. 7, the heater 40 includes a plurality of divided heating sections arranged in the longitudinal direction of the heater 40. In this example, the heater 40 includes a main heating section 55, a left intermediate heating section 56L, a right intermediate heating section 56R, a left end heating section 57L, and a right end heating section 57R. The left intermediate heating section 56L and the right intermediate heating section 56R are disposed on both sides (i.e., left and right sides) adjacent to the main heating section 55. The left end heating section 57L is disposed adjacent to the left intermediate heating section 56L. The right end heating section 57R is disposed adjacent to the right intermediate heating section 56R. The main heating section 55, the left intermediate heating section 56L, the right intermediate heating section 56R, the left end heating section 57L, and the right end heating section 57R correspond to the heating sections. These heating sections will be simply referred to as heating sections 55, 56, and 57 unless it is necessary to distinguish them.

The heating sections 55, 56, and 57 include heating resistors (heating elements) 40*b* wired on a common substrate 40*a*, and the heating resistors 40*b* are electrically independent from each other. The heating sections 55, 56, and 57 are electrically connected to an external driving section via a connection terminal part 40*c* and electric conductive wiring parts (dotted lines) connected to the connection terminal part 40*c*. The heating sections 55, 56, and 57 are configured to individually generate heat by driving currents individually supplied to the respective heating resistors 40*b*.

The divided heating sections 55, 56, and 57 have heating areas controlled in accordance with a width and an orientation of the recording sheet 19. For example, when fixing is performed on a narrow-width sheet such as a postcard, only the main heating section 55 is driven to generate heat. When fixing is performed on a wide-width sheet such as an A3 size sheet fed in a short-edge feed mode or an A4 size sheet fed in a long-edge feed mode, all of the heating sections 55, 56, and 57 are driven to generate heat. Since heating sections are selected in accordance with the recording sheet, energy consumption can be reduced.

Here, structures of the fixing belt 32 and the pressure roller 33 will be described in detail.

Figure 8:
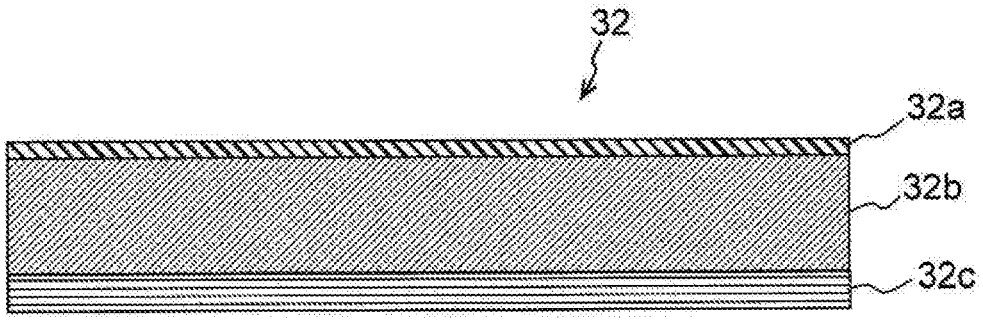
FIG. 8 is a sectional view schematically illustrating a cross-section of a fixing belt.

FIG. 8 is a sectional view schematically illustrating a cross-section of the fixing belt 32. As illustrated in FIG. 8, the fixing belt 32 includes at least three layers, i.e., a surface layer 32*a*, a resilient layer 32*b*, and a base material layer 32*c*. The surface layer 32*a* has releasability and contacts a toner image. The resilient layer 32*b* forms a fixing nip. The base material layer 32*c* imparts endurance and mechanical strength to the fixing belt 32.

It is generally desired that the surface layer 32*a* of the fixing belt 32 is thin enough to follow deformation of the resilient layer 32*b*. However, if a thickness of the surface layer 32*a* is too thin, it may cause wrinkles on the surface layer 32*a* due to sliding friction with the pressure roller 33 or sliding friction with the recording medium. Therefore, the thickness of the surface layer 32*a* is preferably 15 μm to 50 μm. It is also desired that the surface layer 32*a* has heat resistance sufficient to withstand a fixing temperature, and also has high releasability so that the fixed toner is unlikely to stick to the surface layer 32*a*. The surface layer is generally made of fluorine-substituted material. In this example, the surface layer 32*a* is made of PFA material and has a thickness of 30 μm.

The resilient layer 32*b* of the fixing belt 32 is required to have an appropriate rubber hardness and an appropriate thickness in order to form a fixing nip. It is also necessary to reduce loss of heat from a heat source provided on the inner surface side of the fixing belt 32 and to efficiently transmit heat to an outer circumferential surface (toner contact surface) of the fixing belt 32. If the resilient layer 32*b* is thick, a uniform fixing nip can easily be formed, but heat capacity becomes large, and loss of heat increases, which is undesirable. Accordingly, the resilient layer 32*b* preferably has a thickness of 50 μm to 500 μm. Further, the resilient layer 32*b* preferably has a rubber hardness of 20° to 60° in order to enhance uniformity of the fixing nip.

Therefore, in this example, the resilient layer 32*b* is made of silicone rubber having a rubber hardness of 200, a thickness of 300 μm, and heat resistance sufficient to withstand a fixing temperature. The material of the resilient layer 32*b* is not limited to silicone rubber, and any material capable of withstanding a fixing temperature such as fluoro rubber may be used.

The base material layer 32*c* of the fixing belt 32 is required to have high mechanical strength and exhibit excellent endurance against repeated bending and buckling, in order to allow the fixing belt 32 to move without breakage during its lifetime. In this example, therefore, the base material layer 32*c* is made of stainless steel in the form of a sleeve having an outer diameter of 30 mm and a thickness of 30 μm. An example of stainless steel is SUS (Steel Use Stainless) 304.

The material and the thickness of the base material layer 32*c* are not limited to this example, and any material and thickness may be used as long as the base material layer 32*c* has heat resistance and buckling strength sufficient to withstand a fixing temperature and a fixing pressure, and a predetermined Young's modulus. For example, polyimide (PI) and polyether ether ketone (PEEK) may be used, and a filler such as PTFE or boron nitride may be added as needed to improve slidability and thermal conductivity. Additionally, in order to impart electric conductivity, material added with an electric conductive filler containing carbon black or a metallic element such as zinc may be used.

Figure 9A:
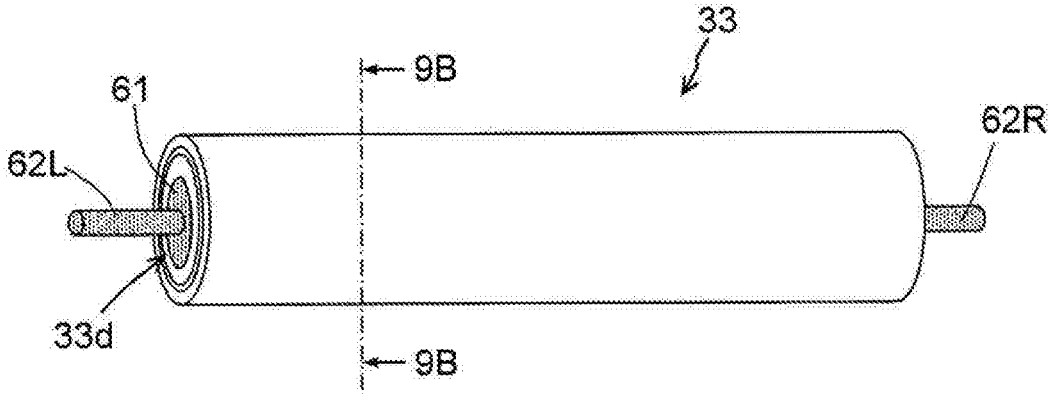
FIG. 9A is a schematic external view showing a pressure roller.
Figure 9B:
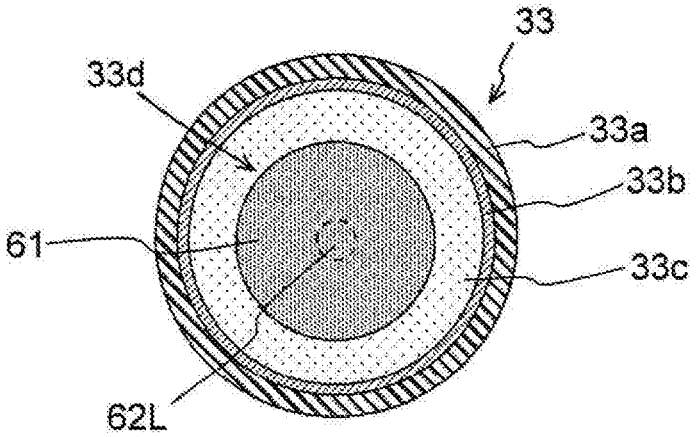
FIG. 9B is a sectional view schematically illustrating a cross-section taken along a line 9B-9B in FIG. 9A.

FIG. 9A is a schematic external view showing the pressure roller 33. FIG. 9B is a sectional view schematically illustrating a cross-section taken along a line 93-98 in FIG. 9A.

As illustrated in FIGS. 9A and 9B, the pressure roller 33 includes at least four layers, i.e., an outer circumferential surface layer 33*a*, an adhesive layer 33*b*, a resilient layer 33*c*, and a metal shaft 33*d*. The outer circumferential surface layer 33*a* contacts the recording sheet 19. The adhesive layer 33*b* bonds the resilient layer 33*c* and the outer circumferential surface layer 33*a* with each other. The resilient layer 33*c* is made of, for example, rubber and forms the fixing nip. The metal shaft 33*d* has sufficient resistance to pressure so as not to deform under the fixing pressure. An adhesive layer may be formed between the metal shaft 33*d* and the resilient layer 33*c* as needed. In this example, the pressure roller 33 has an outer diameter of 30 mm, an inverse crown of −0.2 mm, and a hardness of 50° to 65°. In this example, the resilient layer 33*c* has a thickness of 3 mm.

The outer circumferential surface layer 33*a* of the pressure roller 33 is brought into sliding contact with the recording medium (mainly, paper) and the fixing belt 32. Like the surface layer 32*a* of the fixing belt 32, it is generally desired that the outer circumferential surface layer 33*a* is thin enough to follow deformation of the resilient layer. However, if a thickness of the outer circumferential surface layer 33*a* is too thin, it may cause wrinkles on the outer circumferential surface layer 33*a* due to sliding friction with the fixing belt 32 or sliding friction with the recording medium. Therefore, the thickness of the outer circumferential surface layer 33*a* is preferably 15 μm to 50 μm. It is also desired that the outer circumferential surface layer 33*a* has heat resistance sufficient to withstand a fixing temperature, and also has high releasability so that toner remaining on the fixing belt 32 and paper dust derived from the recording sheet 19 are unlikely to stick to the outer circumferential surface layer 33*a*. The outer circumferential surface layer 33*a* is preferably made of fluorine-substituted material. In this example, the outer circumferential surface layer 33*a* is made of PFA material and has a thickness of 30 μm.

The adhesive layer 33*b* of the pressure roller 33 is used to bond the outer circumferential surface layer 33*a* to the resilient layer 33*c* so as to prevent the outer circumferential surface layer 33*a* from being peeled off from the resilient layer 33*c* and being wrinkled. In this example, a silicone adhesive added with an electric conductive additive (agent) and having excellent adhesion strength and excellent resistance to fixing heat is used. The reason why the electric conductive additive is used in this example is to prevent accumulation of electric charge on the pressure roller 33 during printing, and to prevent paper dust or the like from electrostatically sticking to the pressure roller 33. Although the electric conductive additive is used in this example, a non-electric conductive additive may be used.

Like the resilient layer 32*b* of the fixing belt 32, the resilient layer 33*c* of the pressure roller 33 is required to have an appropriate rubber hardness and an appropriate thickness in order to form the fixing nip. Further, the resilient layer 33*c* is required to have a heat storage property so as to prevent loss of heat transmitted from the fixing belt 32 to a developer (toner) and a printing medium (recording medium or the like). Although the resilient layer 33*c* may be made of solid rubber similar to that of the fixing belt 32, the resilient layer 33*c* in this example is made of a silicone sponge having foam cells for the above-described reason.

In order to prevent a nip mark from remaining on the pressure roller 33 when the pressure roller 33 forms the fixing nip, diameters of foam cells are preferably small. Particularly, an average cell diameter is preferably 20 μm to 250 μm. In this example, silicone rubber having an average cell diameter of about 100 μm is used. The average cell diameter is obtained by cutting the silicone rubber with a razor in a direction of thickness, observing a cross-section using a CCD microscope, measuring diameters of ten cells in a field of view, and calculating an average of the diameters of the ten cells.

In this example, the resilient layer 33*c* is made of silicone rubber added with an electric conductive agent, and has a thickness of 3 mm. The reason why the electric conductive agent is added is to efficiently prevent accumulation of electric charge on the pressure roller 33, as is the case with the adhesive layer 33*b*. Although the electric conductive agent imparting electric conductivity is added in this example, such an electric conductive agent is not necessarily added.

The metal shaft 33*d* of the pressure roller 33 includes a larger-diameter part 61 as a support for the respective layers, and a left smaller-diameter part 62L and the right smaller-diameter part 62R extending from centers of both ends of the larger-diameter part 61. As described above, the left smaller-diameter part 62L is rotatably held by the left side frame 35L, the right smaller-diameter part 62R is rotatably held by the right side frame 35R, and the receiving gear 52 (FIG. 3) is fixed to the right smaller-diameter part 62R. The metal shaft 33*d* need only be made of material capable of withstanding the fixing pressure. The larger-diameter part 61 of the metal shaft 33*d* may be made of a solid core shaft or a hollow tube. In this example, the larger-diameter part 61 is made of a solid core shaft of stainless steel (SUS 304).

Next, in the fixing device 17 having the above-described structure, a temperature distribution in the vicinity of the heater 40 of the fixing belt unit 31 due to heat of the heater 40 will be described.

Figure 10A:
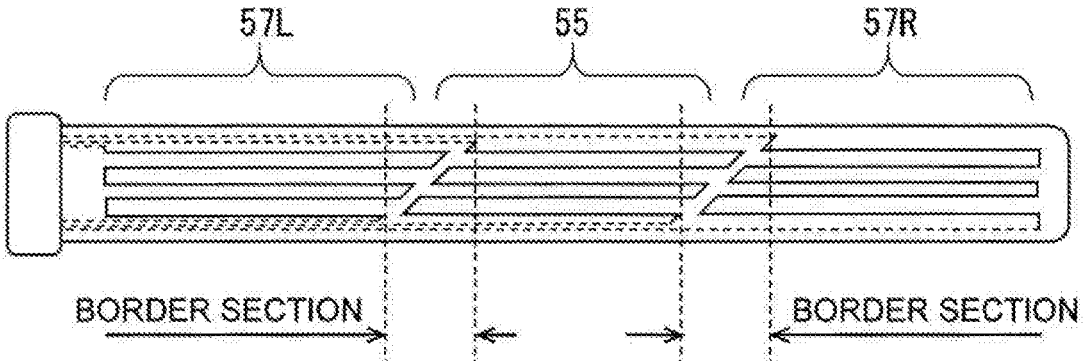
FIGS. 10A and 10B are diagrams illustrating surface temperature distributions of the heater and the fixing belt when a main heating section and left and right end heating sections of the heater generate heat in a state where a thermal diffusion member is removed.
Figure 10B:
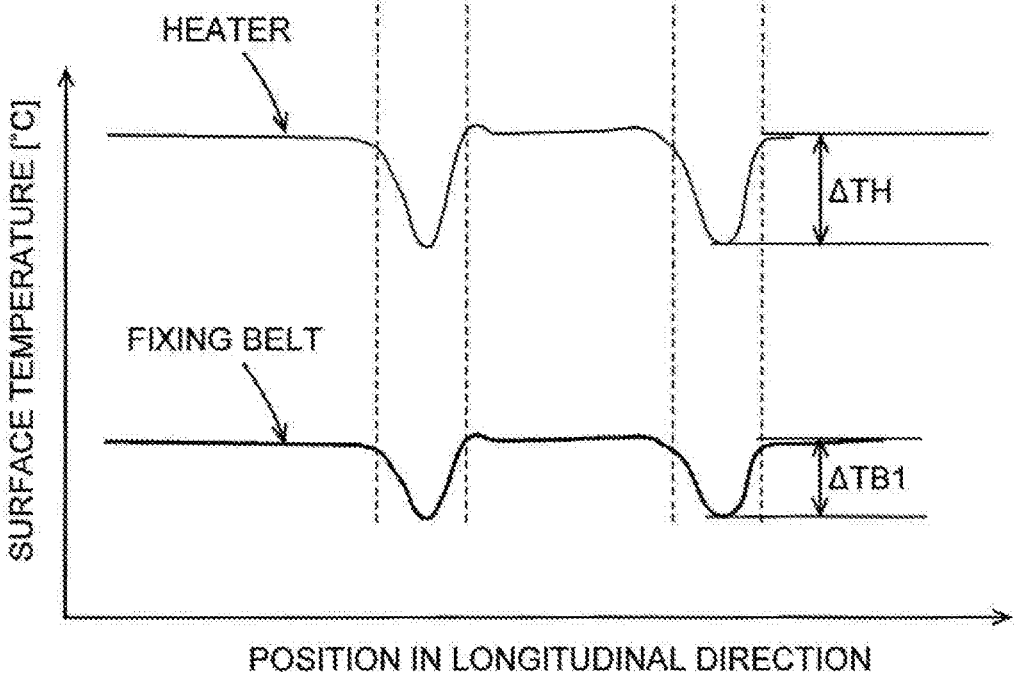
Figure 11A:
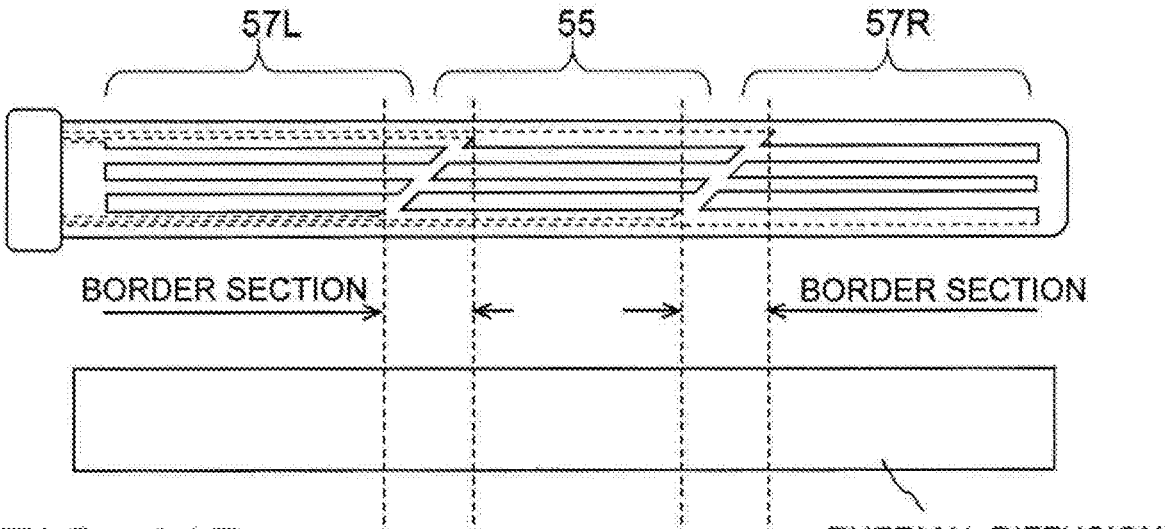
FIGS. 11A and 11B are diagrams illustrating surface temperature distributions of the heater and the fixing belt when the main heating section and the left and right end heating sections of the heater generate heat in a state where the thermal diffusion member is provided.
Figure 11B:
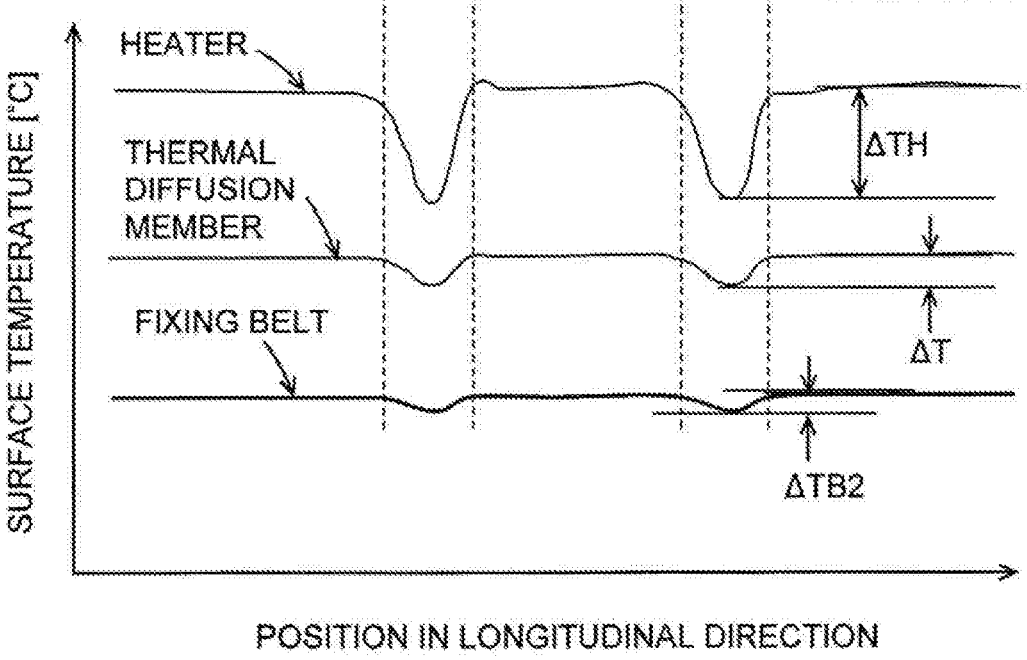

FIGS. 10A and 10B are diagrams illustrating surface temperature distributions of the heater 40 and the fixing belt 32, when the main heating section 55 and the left and right end heating sections 57L and 57R of the heater 40 generate heat in a state where the thermal diffusion member 41 is removed. FIGS. 11A and 11B are diagrams illustrating surface temperature distributions of the heater 40, the thermal diffusion member 41, and the fixing belt 32, when the main heating section 55 and the left and right end heating sections 57L and 57R of the heater 40 generate heat in a state where the thermal diffusion member 41 is provided. For the sake of simplicity, the left and right intermediate heating sections 56L and 56R of the heater 40 are omitted in these figures.

FIG. 10B and FIG. 11B illustrate the surface temperature distributions in the above described components when fixing is performed on a wide-width recording sheet extending throughout the heating sections 55, 57L, and 57R. As is obvious from FIGS. 10B and 11B, the surface temperature of the heater 40 drops and a temperature gap ΔTH occurs at each border section between the adjacent heating sections. This causes the surface temperature of the fixing belt 32 to drop. As a result, a temperature gap ΔTB1 occurs in a state where the thermal diffusion member 41 is removed as illustrated in FIG. 10B, and a temperature gap ΔTB2 occurs in a state where the thermal diffusion member 41 is provided as illustrated in FIG. 11B. When the temperature gap is large, it may result in gloss unevenness of a printing image.

As is obvious from FIGS. 103 and 118, the temperature gap ΔTB2 in a state where the thermal diffusion member 41 is provided is smaller than the temperature gap ΔTB1 in a state where the thermal diffusion member 41 is removed. Thus, it is understood that provision of the thermal diffusion member 41 reduces drop in the surface temperature even in areas of the fixing belt 32 corresponding to the border sections between the heating sections with respect to the remaining areas of the fixing belt 32 corresponding to the heating sections.

Next, description will be made of a thermal diffusion test carried out to evaluate requirements of the thermal diffusion member 41 employed in the fixing device 17 of Embodiment 1. For the thermal diffusion test, a plurality of thermal diffusion members 41' having different specifications are prepared as test samples. Each thermal diffusion member 41' prepared in this example has the same basic structure, but its material, thermal diffusivity D, plate thickness t, and the like are different, as will be described later.

The structure of the thermal diffusion member 41 will be described first. The thermal diffusion member 41 is made of a metal plate in order to efficiently transmit heat from the heater 40 to the fixing belt 32. A surface of the metal plate is coated with a highly abrasion-resistant glass material so as not to deform due to friction with the base material layer 32*c* (FIG. 8) of the fixing belt 32 made of stainless steel (SUS).

In this example, since the base material layer 32*c* of the fixing belt 32 is made of stainless steel (SUS), the surface of the thermal diffusion member 41 is coated with a glass material. However, the glass material may be replaced with any material as long as slidability between the surface of the thermal diffusion member 41 and the inner circumferential surface of the fixing belt 32 can be ensured. For example, a coating material such as polyimide or fluororesin may be used. As long as slidability is imparted to the fixing belt 32, the surface of the thermal diffusion member 41 is not necessarily coated. However, when the thermal diffusion member 41 is made of aluminum, the surface of the thermal diffusion member 41 needs to be coated since aluminum is soft and is prone to deformation and wear.

Figure 12A:
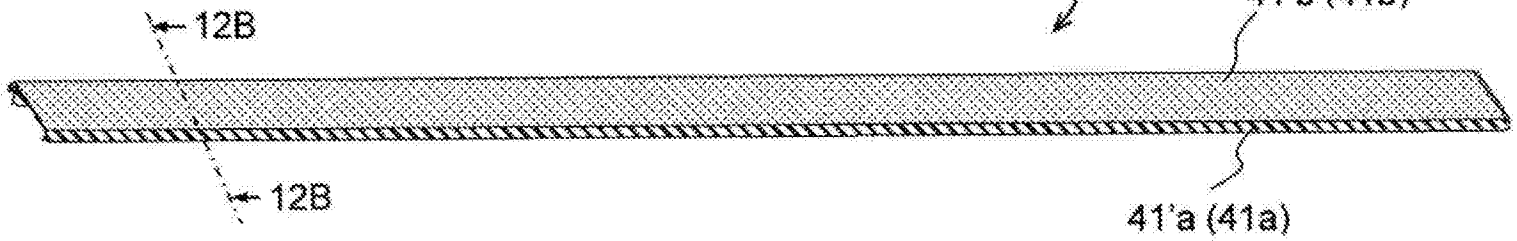
FIG. 12A is a perspective view illustrating a structure of a thermal diffusion member prepared as a test sample for a thermal diffusion test.
Figure 12B:
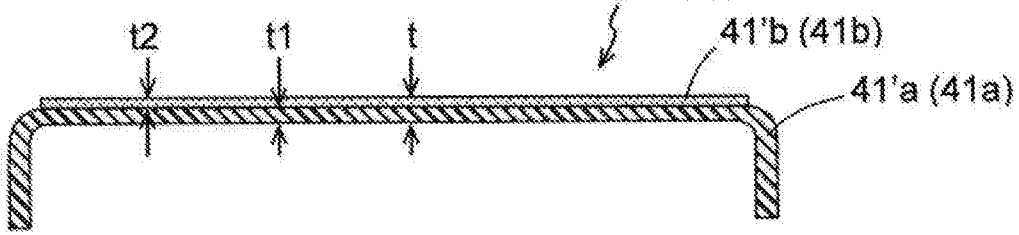
FIG. 12B is a sectional view taken along a line 12B-12B in FIG. 12A.

FIG. 12A is a perspective view illustrating a structure of a thermal diffusion member 41' prepared as a test sample for the thermal diffusion test. FIG. 12B is a sectional view taken along a line 12B-128 in FIG. 12A. As illustrated in FIGS. 12A and 12B, the thermal diffusion member 41' includes a base material plate 41'*a* made of metal, and a cover layer 41'*b* made of glass material and covering a surface of the base material plate 41'*a* facing the fixing belt 32. A thickness of the base material plate 41'*a* is defined as t1, a thickness of the cover layer 41'*b* is defined as t2, and a sum of the thicknesses t1 and t2 is defined as a plate thickness t.

In this regard, the thermal diffusion members 41' (i.e., test samples) satisfying conditions to be described later correspond to the thermal diffusion member 41 according to Embodiment 1. The thermal diffusion member 41' has a shape fittable to the fixing belt unit 31.

Table 1 shows a list of the specifications and evaluation results of 11 thermal diffusion members 41' expressed as Nos. 1 to 11 prepared as test samples for the thermal diffusion test.

The temperatures T1 and T2 in Table 1 were measured in the following manner. As represented in Table 1, the thermal diffusion members 41' having different plate thicknesses t and having the base material plates 41'*a* made of different materials were prepared as the test samples Nos. 1 to 11. In the test, the surface temperature T1 of the thermal diffusion member 41' corresponding to the heating sections 55, 56, and 57 (FIG. 7) was kept at 200° C., and the surface temperature T2 of the thermal diffusion member 41' corresponding to the border sections between the heating sections of the heater 40 was measured. Further, a rise time WU for the surface temperature of the fixing belt 32 (see FIG. 11B) to reach a fixing temperature of 165° C. was also measured.

Next, measurement of the thermal diffusivities D of the stainless steel (SUS) plate, the zinc plate, the aluminum plate, and the glass material will be described. The thermal diffusivities for metal in a thickness direction were measured by preparing thermal diffusion member pieces each having a thickness of 0.6 mm and having no glass cover layer 41'*b*. The conditions of measurement are as follows:

Measuring Device: "Xenon Flash Analyzer LFA467 HyperFlash" Manufactured by NETZSCH Inc.

Detector: InSb

Surface Treatment: Blackening on Both Surfaces of Sample with Graphite Spray (Irradiation Side and Detector Side)

Heating Light: Xenon Flash Light

Pulse Width: 50 to 1,200 μs . . . Improved Finite Pulse Width Correction is Used Charging Voltage: 170 to 260 V Measurement Atmosphere: Helium Atmosphere at 200° C.

This measurement was performed three times, and an average of the three measurement results for each material is shown in Table 2.

TABLE 1

| No. | Base Material | Thermal Diffusivity (nm2/s) | Plate Thickness t (mm) | t × D | Temperature (° C.) T1 | T2 | ΔT | Gloss Difference | WU (s) | EVALUATION RESULT |
|---|---|---|---|---|---|---|---|---|---|---|
| 1 | SUS | 13.35 | 0.3 | 4.0 | 192.4 | 170.4 | 22.0 | 3.8 | 7.3 | Poor |
| 2 | Plate | | 0.4 | 5.3 | 195.6 | 180.0 | 15.6 | 2.8 | 7.8 | Poor |
| 3 | | | 0.5 | 6.7 | 192.8 | 182.8 | 10.0 | 1.4 | 8.5 | Excellent |
| 4 | | | 0.6 | 8.0 | 190.8 | 182.3 | 8.4 | 1.0 | 8.9 | Excellent |
| 5 | | | 0.8 | 10.7 | 192.3 | 185.9 | 6.4 | 1.1 | 9.9 | Excellent |
| 6 | | | 0.9 | 12.0 | 196.5 | 190.7 | 5.8 | 0.9 | 10.9 | Good |
| 7 | Zn | 37.25 | 0.3 | 11.2 | 199.4 | 195.4 | 4.0 | 0.8 | 7.2 | Excellent |
| 8 | Plate | | 0.6 | 22.4 | 199.1 | 196.9 | 2.2 | 0.2 | 7.0 | Excellent |
| 9 | | | 0.9 | 33.5 | 199.8 | 198.6 | 1.2 | 0.2 | 7.1 | Excellent |
| 10 | Al | 72.35 | 0.6 | 43.4 | 199.6 | 198.3 | 1.2 | 0.2 | 6.8 | Excellent |
| 11 | Plate | | 0.9 | 65.1 | 199.9 | 199.2 | 0.7 | 0.3 | 7.0 | Excellent |

In Table 1, the "Base Material" represents a kind of the base material plate 41'*a* (a stainless steel (SUS) plate, a zinc plate, or an aluminum plate). The "Plate Thickness t" represents a sum of the thickness t1 of the base material plate 41'*a* and the thickness t2 of the cover layer 41'*b*, as illustrated in FIG. 12B. The "Temperature T1" represents a temperature of the surface (belt-contact surface) of the thermal diffusion member 41' corresponding to the heating sections 55, 56, and 57 of the heater 40. The "Temperature T2" represents the temperature of the surface (belt-contact surface) of the thermal diffusion member 41' corresponding to the border sections between the heating sections of the heater 40. "ΔT" represents a temperature difference (see FIG. 11B) between the temperature T1 and the temperature T2.

Further, the thermal diffusivity of the glass cover material (i.e., the glass cover layer 41'*b*) was calculated by subtracting a thermal diffusivity of the stainless steel (SUS) plate as a known layer from the measurement result of two layers, i.e., the stainless steel (SUS) plate and the glass material. The thermal diffusivity of the glass material of 50 μm was obtained as 0.15 $m^{=2}/s$.

TABLE 2

| Material | Thermal Diffusivity ($mm^2/s$) |
|---|---|
| SUS Plate | 13.2 |
| Zinc Plate | 37.1 |

TABLE 2-continued

| Material | Thermal Diffusivity ($mm^2/s$) |
|---|---|
| Aluminum Plate | 72.2 |
| Glass Material | 0.15 |

Each thermal diffusion member 41' as the test sample shown in Table 1 includes the glass material (glass cover layer 41'*b*) having a thickness of 50 μm (t2). Accordingly, the thermal diffusivity D of each thermal diffusion member 41' as the test sample shown in Table 1 is defined as a sum of the thermal diffusivity (0.15) of the glass cover layer and the thermal diffusivity (see Table 2) of each metal single-layer.

The "Gloss Difference" in Table 1 represents the difference in gloss (glossiness) between a printing portion corresponding to the heating section of the heater and a printing portion corresponding to the border section (between the heating sections), when the fixing device 17 employing each thermal diffusion member 41' is mounted in a test printing apparatus having the same basic configuration as the image forming apparatus 1 illustrated in FIG. 1, and an red image of 200% is printed by the test printing apparatus. Basically, as the temperature gap ΔT increases, the gloss difference becomes larger.

Each test sample is graded as "excellent", "good", or "poor". A criterion for each grade is as follows:

When WU≤10 s and Gloss Difference≤1.5, the test sample is graded as "excellent".

In this case, the raise time (WU) to reach the fixing temperature is short (i.e., the fixing temperature is reached within time for other correction operations), and the gloss difference is sufficiently small so that gloss unevenness of a printing image is visually imperceptible.

When WU>10 s and Gloss Difference≤1.5, the test sample is graded as "good".

In this case, the raise time (WU) is longer than other correction operations, but the gloss difference is small so that gloss unevenness of the printing image is visually imperceptible.

When WU>10 s and Gloss Difference>1.5, or when WU≤10 s but Gloss Difference>1.5, the test sample is graded as "poor".

In this case, the gloss difference is larger than 1.5, and a printing image defect occurs due to the temperature gap at the border sections between the heating sections of the heater.

From The test results shown in Table 1, it is understood that when the temperature gap ΔT is 10° C. or less, the gloss difference in the printing image is 1.5 or less, and printing image defect can be reduced.

Figure 13:
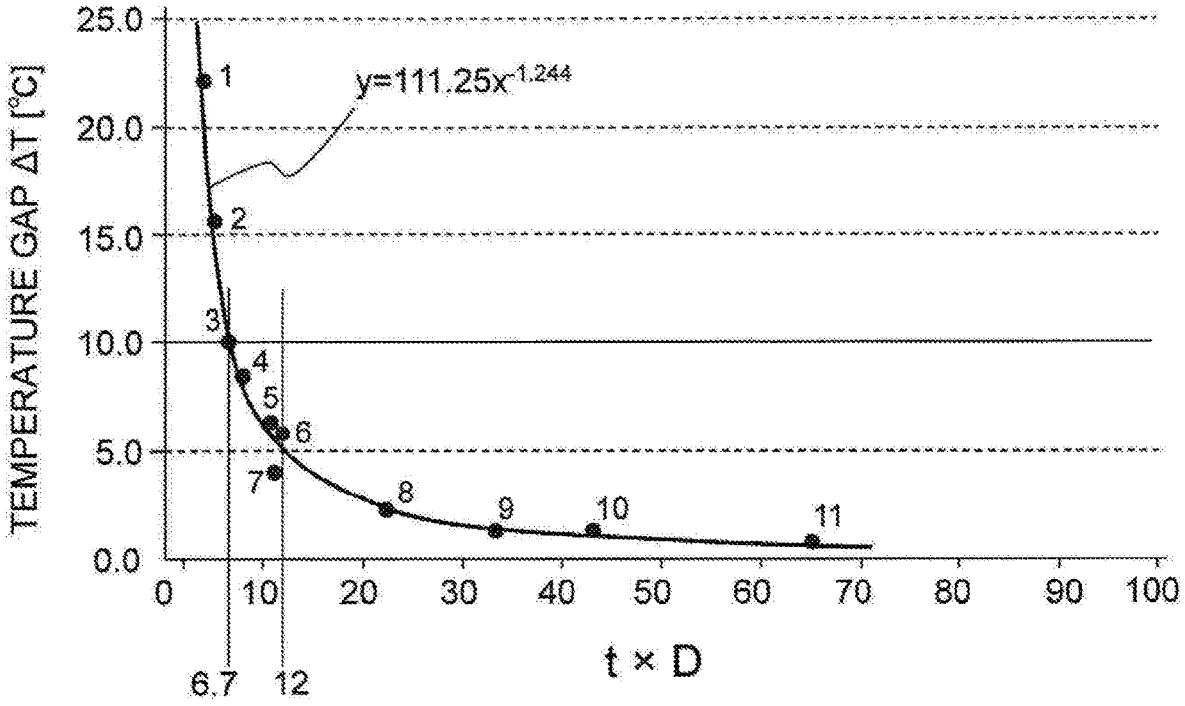
FIG. 13 is a graph illustrating measurement results of test samples Nos. 1 to 11 shown in Table 1, in which a vertical axis indicates a temperature gap $\Delta T$ and a horizontal axis indicates ($t \times D$)

FIG. 13 is a graph illustrating the measurement results of the test samples Nos. 1 to 11 in Table 1 as plots. A vertical axis indicates the temperature gap ΔT, and a horizontal axis indicates (t×D). A further description will be given with reference to FIG. 13.

It is understood that there is a relationship between the temperature gap ΔT and the product (t×D) of the plate thickness t and the thermal diffusivity D of the thermal diffusion member 41'. When "y" is taken on the vertical axis and "x" is taken on the horizontal axis, positions of the plots follow an approximate curve expressed as follows:

$$y=111.25\times x^{-1.244}$$

The $R^2$ value thereof is given by:

$$R^2=0.9825$$

More specifically, as is obvious from FIG. 13, as the plate thickness t of the thermal diffusion member 41' increases, and the thermal diffusivity D of the base material plate 41'*a* increases, the temperature gap ΔT can be reduced. In order to reduce the temperature gap ΔT to 10° C. or less, a configuration satisfying the following relationship (1) is considered to be necessary:

$$(t\times D)\geq 6.7 \quad (1).$$

Further, as is apparent from Table 1, when stainless steel (SUS) is used as the base material plate 41'*a*, as the plate thickness t increases, the temperature gap ΔT decreases and the gloss difference decreases, but the rise time WU for the surface temperature (see FIG. 11) of the fixing belt 32 to reach the fixing temperature of 165° C. increases.

Next, the test results shown in Table 1 and FIG. 13 will be examined.

When heat from the heater 40 reaches the fixing belt 32 through the thermal diffusion member 41', the temperature gap is large on the surface of the thermal diffusion member 41' facing the heater 40. However, the heat diffuses in a surface direction while diffusing in the thickness direction, and thus the temperature gap ΔT is considered to be reduced on the belt-contact surface of the thermal diffusion member 41'. In contrast, the rise time WU is considered to relate to time for the heat to be transmitted to the belt-contact surface of the thermal diffusion member 41'.

Therefore, for example, according to the results of the test samples Nos. 1 to 6 in Table 1, it is considered as follows. For the thermal diffusion members 41' of stainless steel (SUS), as the plate thickness t increases, time for heat transmission from a heater-contact surface to the belt-contact surface increases, and the rise time WU increases. This causes sufficient thermal diffusion in the surface direction, and reduces the temperature gap ΔT.

When general-purpose stainless steel (SUS) is used, it is necessary to set the plate thickness to 0.5 to 0.6 mm in order to reduce the gloss unevenness by shortening the WU time to 10 s or less (to enable quick fixing). In contrast, when material (a zinc plate or an aluminum plate) having a thermal diffusivity higher than that of stainless steel (SUS) is used, the plate thickness t is found to have little influence on the rise time WU and the gloss difference in the evaluated range of the plate thickness.

However, it is considered to be difficult to use a zinc plate or an aluminum plate as the thermal diffusion member 41, because of insufficient resistance to corrosion (rust or the like) and resistance to deformation (warpage) or the like. It is, therefore, preferable to use a stainless steel (SUS) plate having stiffness sufficient to prevent deformation even at a high temperature and a high pressure (by nipping) during fixing.

From the above-described results, it is concluded as follows. The fixing device 17 is configured to heat the fixing nip using the heater 40 having a plurality of heating sections 55, 56, and 57 arranged in a direction perpendicular to the conveying direction (indicated by the arrow A) of the recording sheet 19 in a plane parallel to the recording surface of the recording sheet 19. The thermal diffusion member 41 is provided between the heater 40 and the fixing belt 32. With this configuration, the temperature gap ΔT can be reduced and the gloss unevenness of the printing image can be reduced by optimizing the thermal diffusivity D ($mm^2/s$) and the plate thickness t (mm) of the thermal diffusion member 41.

More specifically, when the product (t×D) of the plate thickness t and the thermal diffusivity D of the thermal diffusion member 41 satisfies the relationship (1), the temperature difference (temperature gap ΔT) between the portion corresponding to the heating section of the heater 40 and the portion corresponding to the border section (between the heating sections) on the belt-contact surface of the thermal diffusion member 41 is reduced to 10° C. or less. Thus, the gloss difference of the printing image can be reduced to 1.5 or less. Therefore, among the test samples Nos. 1 to 11 of the thermal diffusion members 41' shown in Table 1, the test samples Nos. 3 to 11 each correspond to the thermal diffusion member 41 of Embodiment 1. As illustrated in FIG. 13, the thermal diffusion member 41 of Embodiment 1 includes a base material plate 41*a* and a cover layer 41*b*. The base material plate 41*a* may be made of stainless steel (SUS) or other material such as aluminum. The cover layer 41*b* may be made of glass material.

Figure 14:
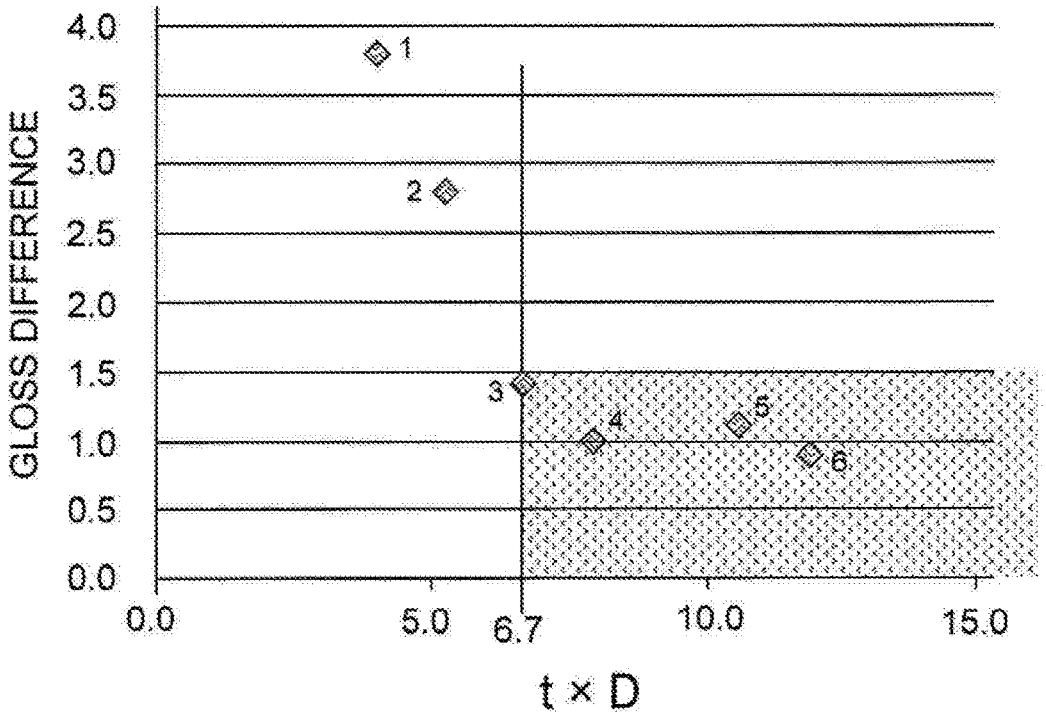
FIG. 14 is a graph illustrating a relationship between a product ($t \times D$) of a plate thickness t and a thermal diffusivity D and a numerical value of a gloss difference, for test samples Nos. 1 to 6 of stainless steel (SUS) shown in Table 1.
Figure 15:
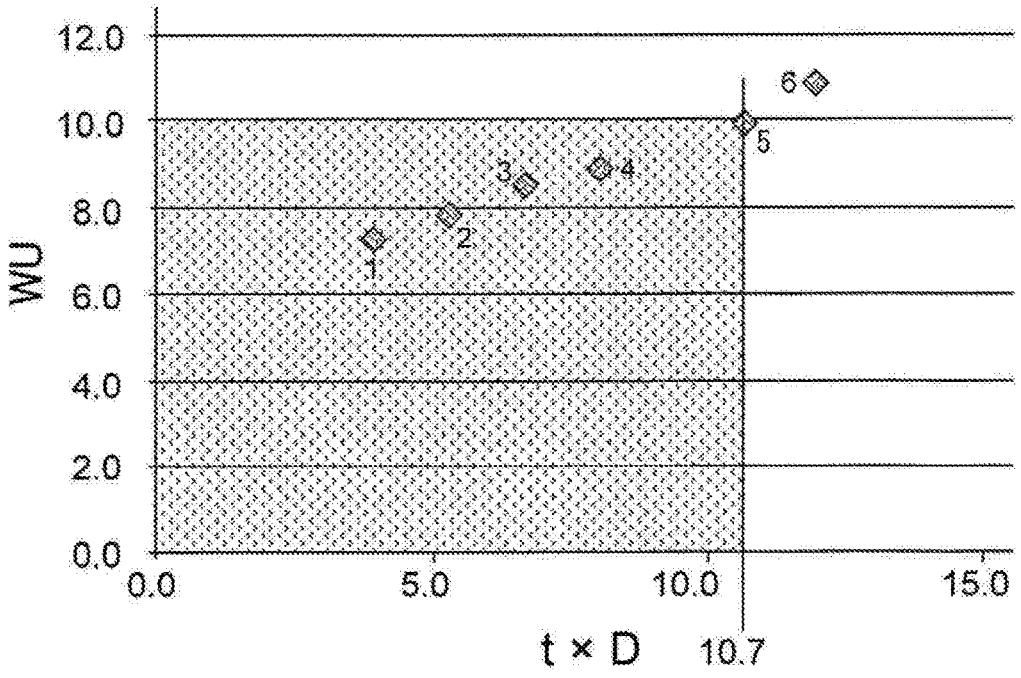
FIG. 15 is a graph illustrating a relationship between the product ($t \times D$) of the plate thickness t and the thermal diffusivity D and a numerical value of WU, for test samples Nos. 1 to 6 of stainless steel (SUS) shown in Table 1.

FIG. 14 is a graph illustrating a relationship between the product (t×D) of the plate thickness t and the thermal diffusivity D and the numerical value of the gloss difference, for the test samples Nos. 1 to 6 made of stainless steel (SUS) shown in Table 1. FIG. 15 is a graph illustrating a relationship between (t×D) and WU for the test samples Nos. 1 to 6 made of stainless steel (SUS). Shaded parts in FIGS. 14 and 15 indicate areas graded as "excellent" under respective conditions.

As is apparent from these tables and drawings, in order to obtain "excellent" grade using stainless steel (SUS), it is necessary to satisfy the following relationship:

$$6.7 \leq t \times D \leq 10.7.$$

Further, in order to obtain "good" grade using stainless steel (SUS), it is necessary to satisfy the following relationship:

$$6.7 \leq t \times D \leq 12.0.$$

As described above, with the image forming apparatus including the fixing device 17 according to Embodiment 1, even when the heater 40 including a plurality of heating sections is used, it is possible to reduce the temperature difference (temperature gap ΔT) between the temperature of the portion corresponding to the heating section of the heater 40 and the temperature of the portion corresponding to the border section (between the heating sections), on the belt-contact surface of the thermal diffusion member 41. Thus, gloss unevenness of the printing image can be reduced.

In the above description of the embodiment and claims, the terms "up" or "upper", "down" or "lower", "left", "right", "front", and "rear" are used merely for the sake of convenience, and are not intended to limit the positional relationship when the image forming apparatus is installed.

In the above described embodiment, an example in which the present invention is applied to an image forming apparatus implemented as a color printer has been described. However, the present invention is not limited to the above described embodiment, but is also applicable to image processing apparatuses such as a copier, a facsimile machine, or an MFP. Although a color printer has been described above, the present invention may also be applied to a monochrome printer.

While the preferred embodiments of the present invention have been illustrated in detail, it should be apparent that modifications and improvements may be made to the invention without departing from the spirit and scope of the invention as described in the following claims.

DESCRIPTION OF REFERENCE CHARACTERS

1 image forming apparatus; 2 housing; 3, 4, 5, 6 image forming unit; 7 transfer unit; 8 driving roller; 9 driven roller; 10 transfer belt; 11 transfer roller; 12 sheet feed cassette; 13 hopping roller; 14 registration rollers; 15 conveying rollers; 16 stacker; 17 fixing device; 18 cleaning blade; 19 recording sheet; 21 photosensitive drum; 22 charging roller; 23 LED heads; 24 developing roller; 25 toner cartridge; 26 cleaning blade; 31 fixing belt unit; 32 fixing belt; 32*a* surface layer; 32*b* resilient layer; 32*c* base material layer; 33 pressure roller; 33*a* outer circumferential surface layer; 33*b* adhesive layer; 33*c* resilient layer; 33*d* metal shaft; 34 lower frame; 35L left side frame; 35R right side frame; 36L left lever; 36R right lever; 37 stay; 38 holding member; 38*a* front regulation groove; 38*b* rear regulation groove; 39 heat retaining plate; 40 heater; 40*a* substrate; 40*b* heating resistor; 40*c* connection terminal part; 41 thermal diffusion member; 41' thermal diffusion member; 41'*a* base material plate; 41'*b* cover layer; 42R right arcuate guide; 43L left regulation plate; 43R right regulation plate; 44L rotation fulcrum; 44R rotation fulcrum; 45L left spring; 51 drive gear train; 52 receiving gear; 55 main heating section; 56L left intermediate heating section; 56R right intermediate heating section; 57L left end heating section; 57R right end heating section.

What is claimed is:

1. A fixing device comprising:

an endless belt;

a heat supply part that is disposed inside the endless belt, contacts an inner circumferential surface of the endless belt, and supplies heat to the endless belt; and a pressure member that contacts an outer circumferential surface of the endless belt to form a nip portion, and conveys a recording medium while nipping the recording medium together with the endless belt, the heat supply part comprising:

a heater having a plurality of heating sections arranged in a widthwise direction of the endless belt, and a thermal diffusion member that extends in the widthwise direction between the heater and the endless belt, and is disposed so that one surface of the thermal diffusion member contacts the inner circumferential surface of the endless belt, and the other surface of the thermal diffusion member contacts the plurality of heating sections, wherein a plate thickness t (mm) between the one surface and the other surface of the thermal diffusion member, and a thermal diffusivity D ($mm^2/s$) of the thermal diffusion member satisfy the relationship:

$$t \times D \geq 6.7.$$

2. The fixing device according to claim 1, wherein the thermal diffusion member comprises a cover layer covering the one surface.

3. The fixing device according to claim 2, wherein the thermal diffusion member is made of stainless steel (SUS) and the cover layer.

4. The fixing device according to claim 1, wherein the cover layer is made of glass material.

5. The fixing device according to claim 1, wherein the plate thickness t satisfies:

$$0.5\ mm \leq t.$$

6. The fixing device according to claim 1, wherein the plate thickness t and thermal diffusivity D satisfy:

$$6.7 \leq t \times D \leq 12.0.$$

7. The fixing device according to claim 1, wherein the plate thickness t and thermal diffusivity D satisfy:

$$6.7 \leq t \times D \leq 10.7.$$

8. The fixing device according to claim 1, wherein the heat supply part comprises a holding member and a heat retaining plate, wherein the heat retaining plate is disposed on a side of the heater opposite to the thermal diffusion member, and wherein the holding member and the thermal diffusion member sandwich the heater and the heat retaining plate.

9. The fixing device according to claim 8, wherein the thermal diffusion member has a U shape such that two ends of the thermal diffusion member in a conveying direction of the recording medium face each other, and wherein the holding member has a pair of regulation grooves into which the two ends are fitted so as to regulate a displacement of the thermal diffusion member with respect to the holding member.

10. An image forming apparatus comprising the fixing device according to claim 1.

* * * * *